US009269321B2

(12) United States Patent
Jamshidi-Roudbari et al.

(10) Patent No.: US 9,269,321 B2
(45) Date of Patent: Feb. 23, 2016

(54) DISPLAY PANEL SOURCE LINE DRIVING CIRCUITRY

(71) Applicant: Apple Inc., Cupertino, CA (US)

(72) Inventors: Abbas Jamshidi-Roudbari, Sunnyvale, CA (US); Ting-Kuo Chang, Cupertino, CA (US); Hopil Bae, Sunnyvale, CA (US); Cheng-Ho Yu, Cupertino, CA (US); Shih Chang Chang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 17 days.

(21) Appl. No.: 14/157,858

(22) Filed: Jan. 17, 2014

(65) Prior Publication Data

US 2014/0232626 A1 Aug. 21, 2014

Related U.S. Application Data

(60) Provisional application No. 61/766,876, filed on Feb. 20, 2013.

(51) Int. Cl.
*G09G 3/36* (2006.01)

(52) U.S. Cl.
CPC ..... *G09G 3/3688* (2013.01); *G09G 2310/027* (2013.01); *G09G 2310/0297* (2013.01)

(58) Field of Classification Search
CPC . G09G 3/3275; G09G 3/3688; G09G 3/3291; G09G 3/3685; G09G 2310/027; G09G 2310/0297
See application file for complete search history.

(56) References Cited

U.S. PATENT DOCUMENTS

| | | | | |
|---|---|---|---|---|
| 6,124,905 | A * | 9/2000 | Iijima | 349/62 |
| 6,268,841 | B1 * | 7/2001 | Cairns | G09G 3/2011 345/100 |
| 7,683,870 | B2 | 3/2010 | Kang et al. | |
| 8,477,092 | B2 | 7/2013 | Neugebauer | |
| 2007/0216631 | A1 | 9/2007 | Nojiri | |
| 2008/0024480 | A1 * | 1/2008 | Jee et al. | 345/212 |
| 2008/0174285 | A1 * | 7/2008 | Morita | G09G 3/3696 323/268 |
| 2009/0289878 | A1 | 11/2009 | Chen | |
| 2013/0141320 | A1 * | 6/2013 | Kim | G09G 3/3685 345/92 |
| 2013/0300722 | A1 * | 11/2013 | Gyouten | G09G 3/3648 345/204 |

FOREIGN PATENT DOCUMENTS

JP WO2012/102229 * 8/2012 ..... G09G 3/36

* cited by examiner

*Primary Examiner* — Ilana Spar
*Assistant Examiner* — Mihir Rayan
(74) *Attorney, Agent, or Firm* — Blakely, Sokoloff, Taylor & Zafman LLP

(57) ABSTRACT

An electronic display system has a light transmissive panel, a region of display elements on the panel, and source lines coupled to the display elements. A demultiplexer circuit has multiple groups of pass gates. Each pass gate has a pair of complimentary on-panel transistors, and the signal outputs of each group are connected to a respective group of the source lines. A display driver integrated circuit (IC) receives video data and timing control signals. A signal input of each group of pass gates is connected to a respective output pin of the driver IC. The display driver IC provides digital timing control signals to control the pass gates of the demultiplexer circuit. Other embodiments are also described.

10 Claims, 5 Drawing Sheets

DISPLAY PANEL SOURCE LINE DRIVING CIRCUITRY

RELATED MATTERS

This application claims the benefit of the earlier filing date of U.S. Provisional Patent Application No. 61/766,876, filed Feb. 20, 2013.

An embodiment of the invention relates to the design of electronic driver circuitry that is used for driving the source lines of a display element array, such as an active matrix liquid crystal display (LCD) thin film transistor (TFT) array. Other embodiments are also described.

BACKGROUND

For many applications, and in particularly in consumer electronics devices, the relatively large and heavy cathode rate tube has been replaced by a flat panel display type, such as a liquid crystal display (LCD), plasma, or organic light emitting diode (OLED). A flat panel display screen contains an array of display elements. Each element is to receive a signal that represents the picture element (pixel) value, such as an intensity value of a particular color, or a gray scale value, to be displayed at that location of the screen. This pixel signal may be applied using a transistor, e.g. a pixel TFT that is coupled to and may be said to be integrated with the display element. The transistor may act as a switch element. It has a carrier electrode that receives the pixel signal, and a control electrode that receives a gate or select signal. The gate signal may serve to modulate or turn on and turn off the transistor so as to selectively apply the pixel signal to the coupled display element.

Typically, thousands or millions of copies of the display element and its associated switch element (e.g., an LCD cell and its associated control transistor) are produced in the form of an array, on a substrate such as a plane of glass or other light transparent material. The array is overlaid with a grid of data or source lines, and gate lines. The source lines serve to deliver the pixel signals to the carrier electrodes of the control transistors, and the gate lines serve to apply the gate or select signals to the control electrodes of the transistors. Each of the source lines is coupled to a respective group of display elements, typically referred to as a column of display elements, while each of the gate lines is coupled to a respective row of display elements. This type of active matrix allows individual display elements to be driven with their respective pixel signal values independently, using a raster scan approach. To do so, each gate or select line is coupled to a gate line driver circuit that is controlled by appropriate timing or clock signals so that it is driven in a vertical shift register fashion. In contrast, the source lines are driven by source line driving circuitry that operates in a horizontal shift register fashion. Together, the line-by-line scanning of the display element array can be achieved.

The source lines are coupled to a source line driver circuit that is within a display driver integrated circuit (or simply display driver IC). The latter translates incoming digital video or digital pixel values (for example red, green and blue digital pixel values) into analog pixels signals that have the appropriate timing, voltage swing and fan-out. The source line driver circuitry performs any needed voltage level shifting or amplification to produce a pixel signal with the needed fan-out or current capability, on each source line.

To reduce overall display system cost, the display driver IC has been encased and installed directly on the light transparent panel that is part of the display screen, rather than being reached via a flex circuit in an off-panel location on a printed circuit board. In addition, the gate line driver circuitry has typically been implemented using essentially TFT on-glass devices, rather than as part of the display driver IC which is built on a separately manufactured microelectronic semiconductor substrate using for example a metal oxide semiconductor (MOS) fabrication process.

To help further reduce the costs of the system and in particular that of the driver IC, attempts have been made to reduce the number of external signal pins of the driver IC. This helps prevent the driver IC from becoming too large. This can be achieved by adding a demultiplexing (demux) function to the source line driving circuitry. The demux in effect allows a single analog external pin of the driver IC, which provides analog pixel signals, to be shared by several source lines or "channels" of the display element array. For example, in a red, green and blue (RGB) LCD panel, a 1:3 demultiplexing approach can be used to supply pixel signals to the three channels, where a group of three source lines are fed by three outputs of a demultiplexer circuit, sequentially from a single input of the demultiplexer circuit. The single input sequentially receives (as controlled by buffers in the display driver IC) red, green and blue analog pixel values. Such a demux circuit has been implemented as a number of single transistor, N-channel TFTs that are operated as switches under control of timing circuitry that is in the display driver IC.

SUMMARY

In attempting to reduce power consumption of an active matrix TFT array display system, the following observations have been made. TFTs are higher voltage devices as compared to MOS field effect transistors, which are the constituent active devices in the driver IC (based on a typical microelectronic fabrication process performed on a semiconductor substrate). As such, a high voltage regulator (e.g., a voltage boost converter power supply circuit) is provided in the display driver IC, in order to generate the higher voltages needed to fully turn on and turn off the constituent TFTs of the gate line driving circuitry and the pixel TFTs. For example, in one instance, the high voltage power supply is referred to as VGH and VGL, where VGH-VGL is typically greater than about 15 Volts dc. This is in contrast to a low voltage regulator or power supply circuit (which is also provided in the driver IC) that can be used, in the case of LCD arrays, to power an amplifier that generates the analog pixel signal that is driven on a source line. The analog pixel signal may need to swing to positive and negative polarity voltages.

An embodiment of the invention is an electronic display system in which the demultiplexer circuit whose outputs are coupled to the source lines receives digital timing control signals that have a small voltage swing, in contrast to the digital timing control signals that are produced by the display driver IC for controlling the gate driver circuitry, even though both the gate driver circuitry and the demultiplexer circuit are implemented essentially using larger threshold-voltage, on-panel transistors such as on-glass TFTs. The display driver IC has a low voltage regulator, which may generate positive and negative power supply voltages that power the buffer circuitry that generates small voltage swing control signals, which are applied to the demultiplexer circuit. A high voltage regulator is also provided, that produces positive and negative power supply voltages that power the buffer circuitry that generates large voltage swing control signals, where the latter are applied to the gate driver circuitry.

In one embodiment, the demultiplexer circuit has multiple groups of pass gates (also referred to as analog transmission gates) wherein each pass gate may have a pair of complementary on-panel transistors (e.g., complementary on-glass TFTs). A signal input of each group of pass gates is connected to a respective analog pixel signal output pin of the driver IC, and multiple signal outputs of each group of pass gates are connected to a respective group of source lines—these are also referred to here as "channels".

In one embodiment, power consumption may be reduced at least in part because of the smaller voltage swing of the control signals that are applied to the control electrodes of the pass gates in the demultiplexer circuit. Thus, in one embodiment, rather than producing these control signals using the high power supply voltages of VGH and VGL (typically used for controlling the on-panel gate driver circuitry and pixel TFTs), the lower power supply voltages VDDH and VDDN are used instead, where the latter power supply voltages may also be used by the source line amplifiers that drive the analog pixel signals (from the driver IC). In such an embodiment, the display driver IC has a number of buffer circuits where each buffer generates a pair of small voltage swing digital control signals that are applied to a pair of control electrodes of a respective pass gate, in several groups of pass gates. This embodiment also allows circuitry in the driver IC to adjust the slew rate (fall time or rise time) of those small voltage swing digital control signals, in order to, for example, reduce cross-talk or interference, manage power consumption and meet timing margins.

In another embodiment, each of the driver IC buffer circuits, i.e. in the driver IC, that produces a demultiplexer controlling signal (with small voltage swing) is coupled to drive one, not both, of the two control electrodes of its respective pass gate (in each group of pass gates associated with a given source line group). In such an embodiment, a number of small voltage swing inverters are provided that are implemented using on-panel transistors (e.g., made essentially of only on-glass TFTs). An output of each driver IC buffer is coupled to an input of a respective one of the on-panel inverters, in addition to one of the pair of control electrodes of the respective pass gate, while an output of the respective inverter is coupled to the other one of the pair of control electrodes of the respective pass gate. With this approach, there is no significant increase in the number of active circuit elements needed in the driver IC in comparison to the typical approach where the demultiplexer circuit consists of only single-transistor switches (rather than transmission gates). However, in this embodiment, the driver IC may not be able to adjust the slew rate of the actual controlling signals at the control electrodes of the pass gates, because of the presence of the inverters. Power consumption, however, may advantageously be lowered in this case, because the voltage swing on the control electrodes of the pass gates can be smaller, for example, VDDH-VDDN rather than VGH-VGL.

In a further embodiment, the buffer circuits in the driver IC produce large voltage swing digital control signals for the demultiplexer. Each large voltage swing control signal is used to control its respective pair of pass gate control electrodes through an inverter and a buffer (both of which may be external to the driver IC,), to achieve the needed inverse relationship between the control electrode voltages of a pass gate. The external buffer may be implemented as a pair of series coupled inverters. The constituent transistors of all three external inverters may be on-panel TFTs, although these inverters are still powered by the lower power supply voltages. In an alternative approach for this embodiment, the buffer circuits in the driver IC may produce small voltage swing digital controls (by for instance also being powered by the lower power supply voltages).

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever aspects of the parts in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
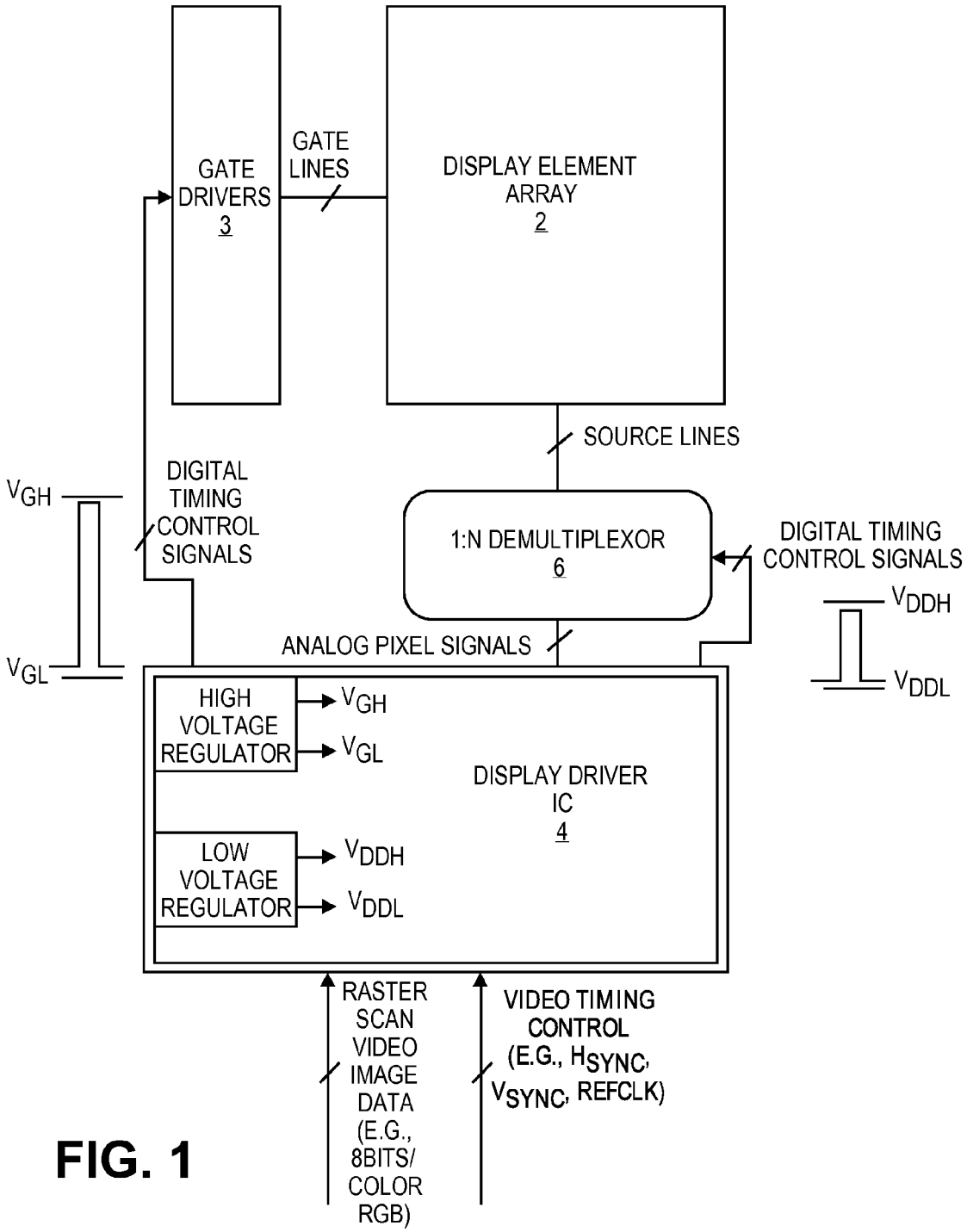
FIG. 1 is a block diagram of an electronic display system.

FIG. 1 is a block diagram of an electronic display system in accordance with an embodiment of the invention. The system has a display element array 2 that may be made of display elements or display cells such as LCD cells formed on a light transparent panel. The light transparent panel may be deemed to overlay the region of display elements 2, and also serves to carry electronic components, for example, a display driver IC 4 and on-panel driver circuitry including the gate drivers 3 and a demultiplexer 6. In the case of an LCD panel, the light transparent panel simultaneously serves to pass light that has been modulated by display cells in the display element array 2, in accordance with raster scan video image data received from an external processor, a graphics processor, and frame buffer memory. The light transparent panel may be made of various materials and/or layers that are sufficiently light transparent, in order to enable light modulated by the display element array 2 to pass through and be visible to a human user, so as to enable a video display screen function. Examples include a glass panel or a polycarbonate panel or other sufficiently clear (light transparent) composite panel having one or more layers.

Each display element or cell within the display element array 2 generally serves to modulate light that has been produced by a light source (e.g., a backlight) or a reflector, which may be either integrated with the panel behind the region of display elements, or may be emitted by the individual cells of the array 2 itself. In the case of an LCD cell, each cell may have a liquid crystal capacitance that is formed between two layers, and may also have a storage capacitance connected in parallel to enhance the signal storage ability of the individual display element.

In one embodiment, the display element array 2 has an active matrix of TFTs that allow each individual display element to be addressed, for writing a pixel signal value therein. This may be enabled by a conductive grid, which may be made of a number of gate (select) lines that are generally perpendicular to a number of source (data) lines. The gate lines are shown to be oriented horizontally or row-wise, and the source lines are shown as oriented vertically or column-wise. The active matrix may be addressed by asserting a control signal on a gate line, using the gate drivers 3, for example one row at a time in a vertical or vertical shift register fashion. A given display element is addressed when its pixel signal value appears, during assertion of the gate line to which it is connected, on its associated source line. The source lines are addressed in a horizontal shift register manner, by source line driving circuitry that includes a demultiplexer 6, buffers that generate controlling signals and are connected to the control inputs of the demultiplexer 6, and amplifiers that generate the analog pixel signals.

In one embodiment, the buffers and the amplifiers of the source line driving circuitry are within the display driver IC 4, which may be a separately manufactured microelectronic semiconductor chip, e.g. a chip that is manufactured using MOS transistor fabrication techniques on a silicon or other suitable semiconductor substrate. A direct on-panel interconnect technique should be used to communicatively couple the driver IC 4 to conductive traces in the panel, such as a chip on-glass interconnect mechanism. In contrast, the constituent active devices or transistors of the demultiplexer 6 and the gate drivers 3 are said to be on-panel transistors, examples of which include on-glass TFTs. Among several, one relevant distinguishing feature of an on-panel transistor relative to a standard MOS FET of the driver IC 4 is substantially greater threshold voltage, and hence the need for larger voltage swing on the control electrodes of the on-panel transistor in order to achieve a fully-on state.

The display driver IC 4 produces the analog pixel signals with appropriate timing, together with digital timing control signals to operate the demultiplexer 6 and the gate drivers 3, based on digital video data that it receives as raster scan video image data and video timing control signals from an external processor, e.g. a video or graphics processor and a frame buffer memory. As such, the display driver IC 4 includes logic circuitry, voltage level shifters, as well as digital-to-analog conversion circuitry and analog amplifiers (not shown in FIG. 1) as needed to scan the display element array 2 with the analog pixel signals to be written therein. To do so, the display driver IC 4 may be equipped with at least two voltage regulators, namely a low voltage regulator that produces VDDH and VDDL (e.g., +5 Vdc and −5 Vdc), and a high voltage regulator that produces VGH and VGL (for example, $V_{GH}$-$V_{GL}$>15 volts dc). The low voltage regulator's power supply voltages are used by the buffers of the display driver IC in producing the small swing digital timing control signals (for the demultiplexer 6), while the digital timing control signals for the gate drivers or pixel TFTs have large voltage swing. As to the analog pixel signals, these may be produced by suitable amplifiers that may also be powered by the low voltage regulator and hence limited to the smaller voltage swing, e.g. between VDDL and VDDH.

Figure 2:
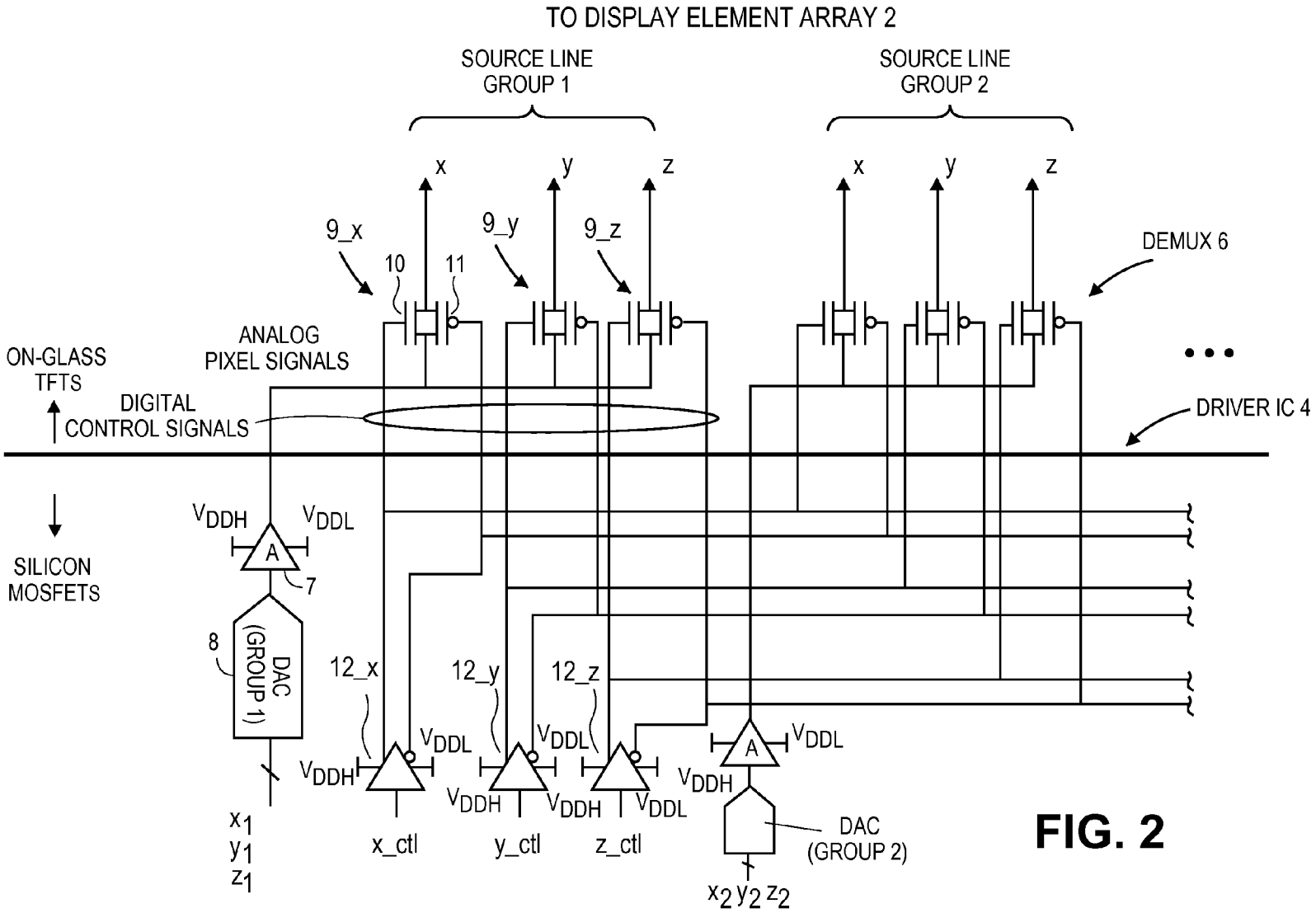
FIG. 2 is circuit schematic of source line driving circuitry in the display system.

Turning now to FIG. 2, a circuit schematic of source line driving circuitry in accordance with an embodiment of the invention is shown. Some of the source line driving circuitry resides within the driver IC 4 and may therefore be implemented using, for example, standard semiconductor substrate-based microelectronic transistor fabrication techniques (e.g., silicon MOS FETs), while the rest of the source line driving circuitry shown is implemented essentially using on-panel transistors, such as on-glass TFTs. In particular, the demultiplexer 6 is implemented on-panel, and may consist of several groups of analog transmission gates or pass gates 9, where in this example each group consists of three pass gates 9_*x*, 9_*y* and 9_*z*. This, of course, is just an example as more generally each group of pass gates may be N=2 or more pass gates, thereby providing a 1:N demux function. Items associated with the x, y, and z subscripts here may also be referred to as the x channel, y channel and z channel items.

Still referring to FIG. 2, each pass gate 9 in one embodiment may consist essentially of a pair of complementary TFTs, namely N-channel TFT 10 and P-channel TFT 11, which are connected in parallel as shown to provide a pair of control (gate) electrodes, respectively, that receive a pair of controlling signals. Examples of fabrication techniques that may be used here for implementing the complementary transistors include polysilicon TFT. Each pass gate 9 as a whole creates a low impedance path from its signal input to its signal output, even though both of the TFTs 10, 11 might not be turned "fully-on", as follows. To turn on the pass gate, the digital control signal applied to the gate of the N-channel TFT 10 is at VDDH, while the control signal applied to the gate of the P-channel TFT 11 is at VDDL. Now, under those circumstances, if the signal input rises to near VDDH then the N-channel TFT 10 is partially but not fully turned on, yet the P-channel TFT 11 is fully turned on, thereby achieving the desired low impedance path. If the signal input drops to near VDDL then in that case the P-channel TFT 11 is partially, and not fully, turned on, yet the N-channel TFT 10 is fully turned on, which again achieves the desired low impedance path. A complementary situation arises when the gate of the N-channel TFT 10 is at VDDL, while the gate of the P-channel TFT 11 is at VDDH, with again the desired result of a low impedance being assured.

The digital control signals applied to each of the pass gates 9 may be inverse versions of each other and are produced by a respective buffer 12 (so that buffer 12_*x* drives pass gate 9_*x*, buffer 12_*y* drives pass gate 9_*y*, etc.). In one embodiment, each buffer 12_*x*, 12_*y*, or 12_*z* may be implemented as a single node to which a pull-up transistor switch (VDDH) and a pull-down transistor switch (VDDL) are connected, and those two switches are controlled by inverse signals, as dictated by the digital x_ctl, y_ctl, or z_ctl signals within the driver IC 4 (see also FIG. 3 discussed below). This results in a pair of controlling signals being generated (for each pass gate 9) that may essentially be inverses of each other or inverted versions of each other. It should be noted here that in order to decrease the load impedance presented to each of the pull-up or pull-down circuits (or other suitable buffer circuit 12), there may be more than one output signal pin in the driver IC 4 that is connected simultaneously to conduct a given controlling signal to a gate electrode of a pass gate 9—see for example FIG. 5.

In one embodiment, the signal inputs of the pass gates 9 in each group are connected to each other and to a single external pin of the driver IC 4, and this pin is driven by an instance of an amplifier 7. The amplifier 7 may serve to provide fan-out and/or voltage level shifting to the output of a digital to analog converter (DAC) 8, depending upon the resolution of the display element array and the particular needs of display cell technology used in the array 2. In one embodiment, one instance of the amplifier 7 serves to drive the odd numbered groups of source lines, while another instance of the amplifier 7 serves to drive the even numbered groups (beginning with source line group 2 as shown).

Figure 3:
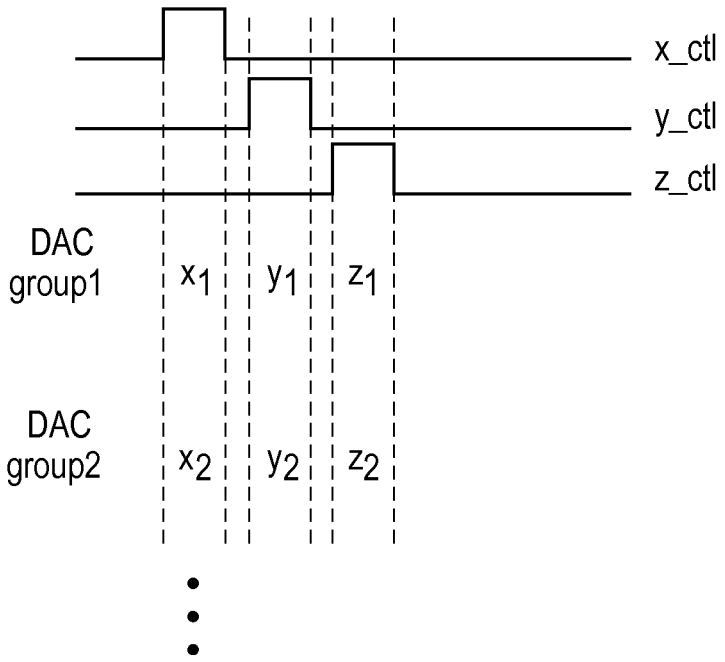
FIG. 3 shows waveforms for demultiplexer control signals including relative timing in relation to groups of analog pixel signals.

Each group of source lines has a respective DAC that sequentially receives N digital pixel values (in this example, N=3 corresponding to Red, Green and Blue pixel values). FIG. 3 shows an example timing diagram for the internal controlling signals x_ctl, y_ctl and z_ctl that are generated in the driver IC 4 and that are then translated into external complementary controlling signals (when one is at a high voltage the other is at a low voltage, and vice versa) by the buffers 12_*x*, 12_*y*, and 12_*z* respectively. As seen in FIG. 3, the driver IC 4 is responsible for producing several $x_i$ digital pixel values in parallel (e.g., the red pixel values for groups 1, 2, . . . , K) with the correct timing to overlap the assertion of x_ctl, and then several $y_i$ digital pixel values in parallel (e.g., blue pixel values for groups 1, 2, . . . K) to overlap the assertion of y_ctl, etc. This allows a row of the display element array 2 to be written in a scanning or shift register fashion (while the select or gate signal to that row is asserted—not shown). The process shown in FIG. 3 repeats for each row until the entire display element array 2 has been written (during a display frame interval).

It should be noted that in the embodiment of FIG. 2, the driver IC 4 does not need to be equipped with additional external pins that are dedicated to provide the power supply voltages VDDH, VDDL to active devices outside of the driver IC 4, and there is no need for routing traces that conduct power supply voltages to any active devices in the demultiplexer 6. However, as seen in the figure this embodiment does need two external pins in the driver IC 4 to route two digital controlling signals to each pass gate 9 (one for each of the complementary TFTs 10, 11). In other words, there are two controlling signal lines from the driver IC 4 (requiring at least two external pins) for each of the x, y and z channels. It should also be noted here that this embodiment does allow the slew rate (fall time or rise time) of the pass gate controlling signals to be adjusted by circuitry inside the driver IC 4 (not shown).

Figure 4:
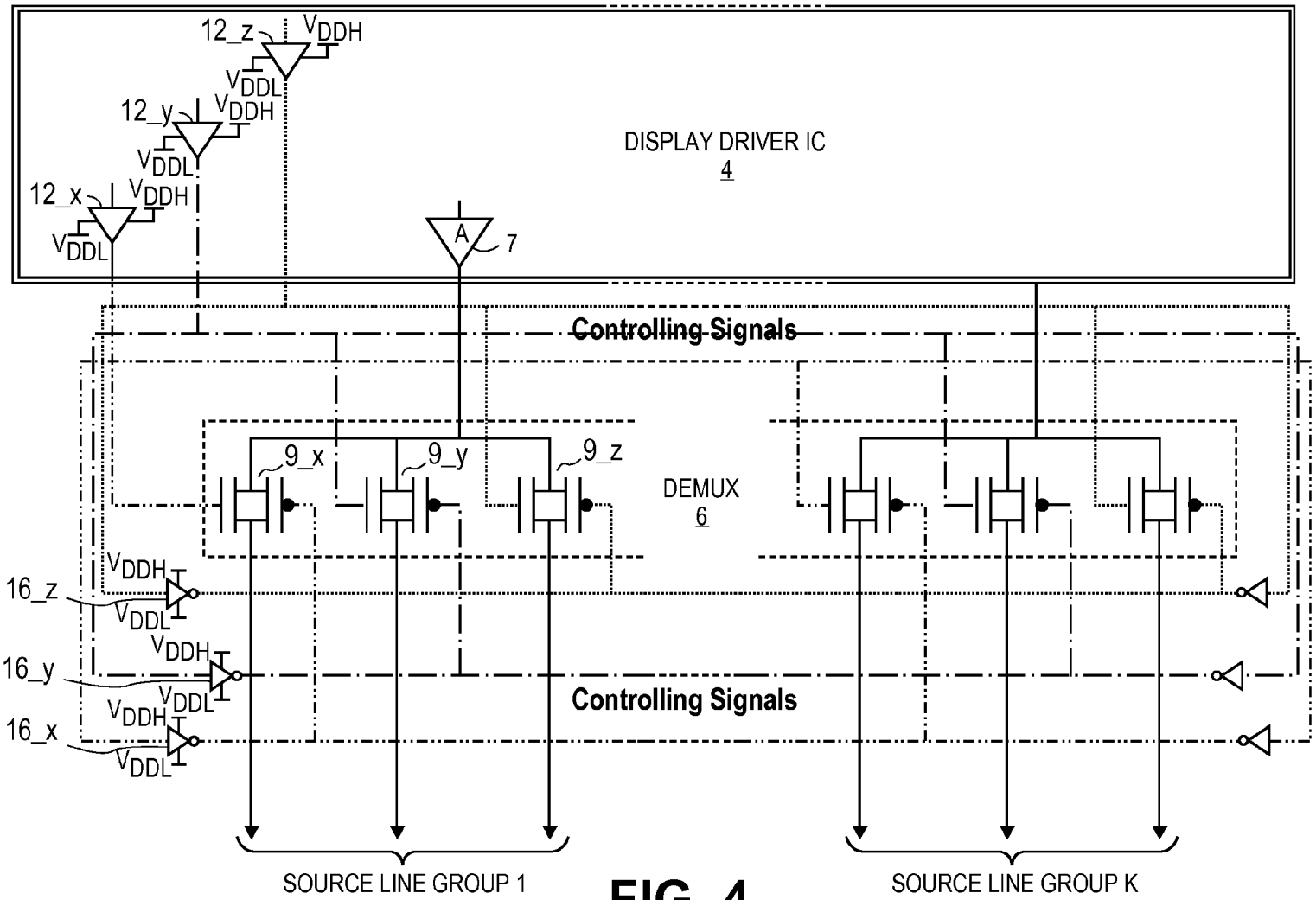
FIG. 4 is a circuit schematic of source line driving circuitry, in accordance with another embodiment of the invention.

Turning now to FIG. 4, in this embodiment of the invention, each buffer 12_*x*, 12_*y*, or 12_*z* is coupled to drive one, not both, of the pair of gate electrodes of its respective pass gate 9_*x*, 9_*y*, or 9_*z*. The other control electrode of the respective pass gate 9_*x*, 9_*y*, or 9_*z* is driven by a respective inverter 16_*x*, 16_*y* or 16_*z* that has small voltage swing (relative to VGH and VGL) by virtue of receiving lower power supply voltages VDDH, VDDL (that may be routed from the driver IC 4). The constituent active devices of the inverters 16 are on-panel TFTs. Each inverter 16_*x*, 16_*y*, or 16_*z* receives at its input the small voltage swing controlling signal from the output of its respective buffer 12_*x*, 12_*y*, or 12_*z*. It should be noted here that as shown in the figure, there may be more than one instance of the inverter 16_*z* driving the same control electrode of a pass gate 9_*z* in parallel, and there may be more than one instance of the pass gate 9_*z* (which are in different source line groups) that are being controlled by the same buffer 12_*z*, in order to improve performance.

The embodiment of FIG. 4 may reduce the number of external pins needed for the driver IC 4 as compared to the embodiment of FIG. 2, because there is only one controlling signal line needed for each x, y, and z channel (since the inverse controlling signal needed for each pass gate is generated by the inverter 16 which is on-panel TFT-based). A further advantage to this embodiment may be that there should be no significant increase in the total number of active devices in the driver IC 4, relative to the conventional approach where the demultiplexer 6 consists instead of just single-transistor switches (rather than complementary transistor pass gates 9). Note further that in contrast to the embodiment of FIG. 2, in FIG. 4 it may not be possible to adjust the slew rate of the controlling signals on both gate electrodes of each pass gate 9, from inside the driver IC 4.

Figure 5:
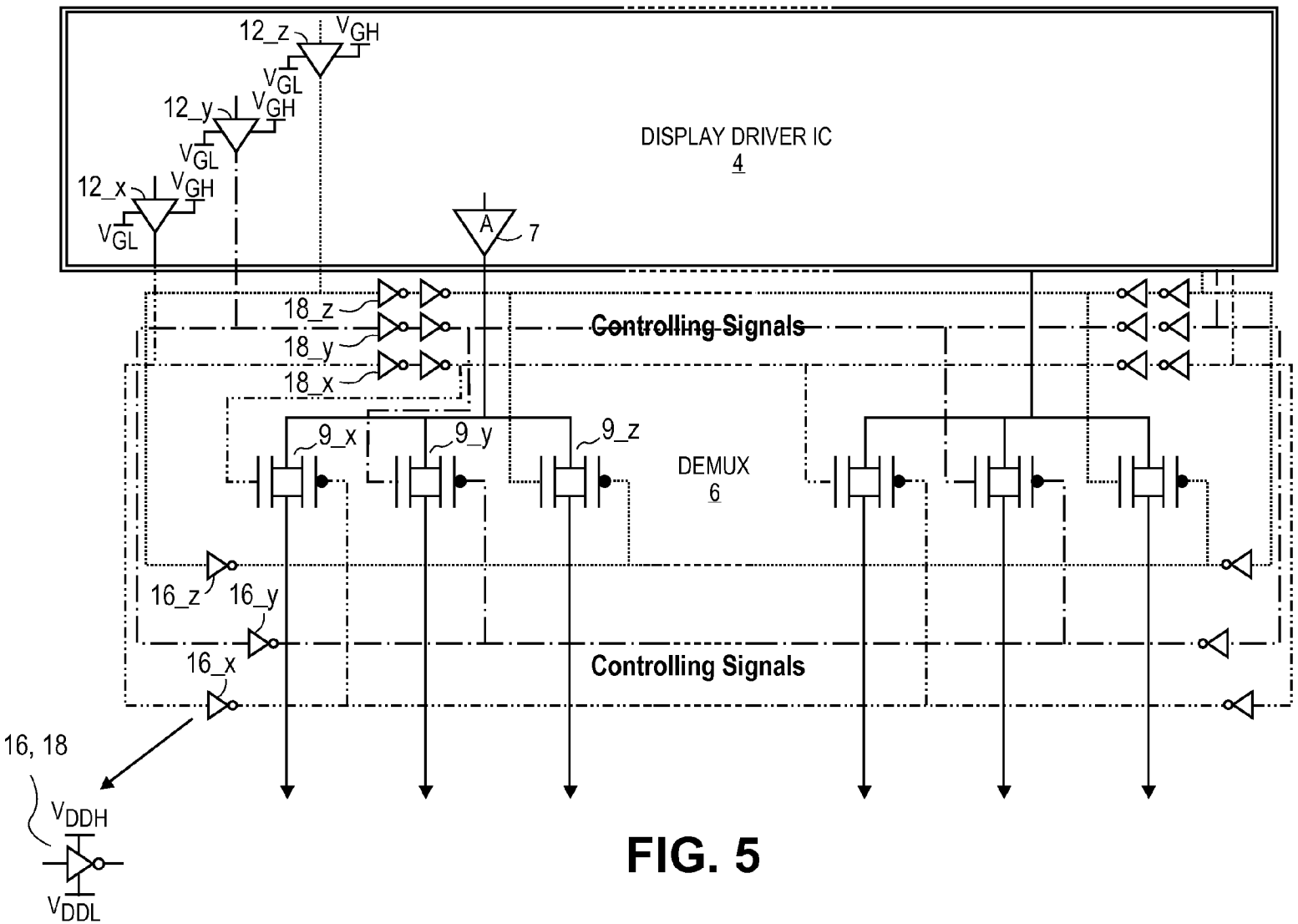
FIG. 5 shows a circuit schematic of yet another embodiment of the source line driving circuitry.

FIG. 5 is a circuit schematic of yet another embodiment of the invention. The pass gates 9 that make up the demux 6 may be similar to those in the embodiments described above. Here however, the buffers 12 that produce the controlling signals for the demux 6 may, or may not, be powered by a higher power supply voltage than VDDH, VDDL. One example here is to use the existing VGH, VGL to power the buffers 12, in essentially a conventional manner, but to add non-inverting buffers 18 in addition to the inverters 16, both of which are powered by the low voltage regulator VDDH, VDDL (to achieve reduced power consumption). The constituent active devices of the non-inverting buffers 18 and the inverters 16 may be on-panel TFTs. The use of an inverter 16_*x* and a corresponding non-inverting buffer 18_*x* as shown in the schematic yields the needed inverse relationship between the controlling signals at the gate electrodes of the pass gate 9_*x*, based on a single external pin of the driver IC 4 that routes the output from the buffer 12_*x*. This embodiment still needs VDDH, VDDL to be routed, for example from a voltage regulator circuit inside the driver IC 4, to power the inverters 12 and non-inverting buffers 18. In addition, slew rate of the control electrode signals of the pass gates 9 may not be achieved in this case from directly inside the driver IC 4. However, with this embodiment, there may be no need for changes to the circuit design of the buffers 12 (which may be implemented as conventional circuitry inside the driver IC 4,) while still achieving reduced power consumption due to the use of smaller voltage swing digital control signals for the pass gates 9 of the demultiplexer 6.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although each of the pass gates 9 depicted in the figures is a pair of complementary, parallel-connected TFTs, the pass gate may alternatively be a more complex circuit that could yield improved performance. The description is thus to be regarded as illustrative instead of limiting.

What is claimed is:

1. An electronic display system comprising:

a light transmissive panel;

a region of display elements on the panel;

a plurality of gate lines and a plurality of source lines coupled to the display elements;

gate driver circuitry having on-panel transistors that are coupled to the gate lines;

a demultiplexer circuit having on-panel transistors that have a plurality of outputs coupled to the source lines as a plurality of groups of pass gates, wherein each pass gate comprises a pair of complimentary TFTs, and a plurality of signal outputs of each group of pass gates are connected to a respective group of the plurality of source lines;

a display driver integrated circuit (IC) to receive video data and timing control signals, and having outputs coupled to analog inputs of the demultiplexer circuit, the display driver IC to provide digital timing control signals to control the on-panel transistors of the demultiplexer circuit, and digital timing control signals to control the on-panel transistors of the gate driver circuitry, wherein the control signals for the gate driver circuitry have a large voltage swing and the control signals for the demultiplexer circuit have a small voltage swing, and wherein a signal input of each group of pass gates of the demultiplexer circuit is connected to a respective output pin of the driver IC, and wherein the display driver IC comprises a plurality of buffer circuits each being coupled to drive one and not both of a pair of control electrodes of a respective pass gate in the plurality of groups of pass gates of the demultiplexer circuit; and a plurality of small voltage swing on-panel inverters whose constituent active devices are on-panel TFTs, wherein an output of each of the plurality of buffer circuits in the display driver IC is coupled to a respective one of the on-panel inverters, and an output of the on-panel inverter is coupled to another one of the pair of control electrodes of the respective pass gate.

2. The electronic display system of claim 1 wherein the display driver IC comprises a low voltage regulator that generates positive and negative power supply voltages, which are used to power driver circuitry that generates the small voltage swing control signals, and a high voltage regulator that produces positive and negative power supply voltages, which are used to power driver circuitry that generates the large voltage swing control signals.

3. An electronic display system comprising:

a light transmissive panel;

a region of display elements on the panel;

a plurality of source lines coupled to the display elements;

a plurality of gate lines coupled to the display elements;

gate driver circuitry having on-panel transistors that are coupled to the gate lines;

a demultiplexer circuit having a plurality of groups of pass gates wherein each pass gate comprises a pair of complimentary on-panel transistors, and wherein a plurality of signal outputs of each group of pass gates are connected to a respective group of the plurality of source lines;

a display driver integrated circuit (IC) to receive video data and timing control signals, wherein a signal input of each group of pass gates is connected to a respective output pin of the driver IC, the display driver IC to provide digital timing control signals that have small voltage swing and that drive control electrodes of the pass gates of the demultiplexer circuit, and wherein the display driver IC is to generate further control signals that have large voltage swing and that drive the gate driver circuitry, and wherein the display driver IC comprises a plurality of buffer circuits each being coupled to drive one and not both of a pair of control electrodes of a respective pass gate in the plurality of groups of pass gates of the demultiplexer circuit; and a plurality of small voltage swing on-panel inverters, wherein an output of each of the plurality of buffer circuits in the display driver IC is coupled to a respective one of the on-panel inverters, and an output of the on-panel inverter is coupled to another one of the pair of control electrodes of the respective pass gate.

4. The system of claim 3 wherein the display driver IC comprises a low voltage regulator that generates positive and negative power supply voltages, which are used to power driver circuitry that generates the small voltage swing control signals, and a high voltage regulator that produces positive and negative power supply voltages, which are used to power driver circuitry that generates the large voltage swing control signals.

5. The system of claim 3 wherein the display driver IC comprises a low voltage regulator that generates positive and negative power supply voltages used to produce the small voltage swing signals, and a high voltage regulator that produces positive and negative power supply voltages used to produce the large voltage swing signals.

6. An electronic display system comprising:

a light transmissive panel;

a region of display elements on the panel;

a plurality of gate lines and a plurality of source lines coupled to the display elements;

gate driver circuitry having on-panel transistors that are coupled to the gate lines;

a demultiplexer circuit having on-panel transistors that have a plurality of outputs coupled to the source lines as a plurality of groups of pass gates, wherein each pass gate comprises a pair of complimentary TFTs, and a plurality of signal outputs of each group of pass gates are connected to a respective group of the plurality of source lines;

a display driver integrated circuit (IC) to receive video data and timing control signals, and having outputs coupled to analog inputs of the demultiplexer circuit, the display driver IC to provide digital timing control signals to control the on-panel transistors of the demultiplexer circuit, and digital timing control signals to control the on-panel transistors of the gate driver circuitry, wherein the control signals for the gate driver circuitry have a large voltage swing and the control signals for the demultiplexer circuit have a small voltage swing, wherein a signal input of each group of pass gates of the demultiplexer circuit is connected to a respective output pin of the driver IC, and wherein the display driver IC comprises a plurality of buffer circuits each being coupled to drive a) one of a pair of control electrodes of a respective pass gate, in the plurality of groups of pass gates of the demultiplexer circuit, through an inverter, and b) another one of the pair of control electrodes of the respective pass gate through a non-inverting buffer, to yield inverse control signals for the demultiplexer, and wherein the inverter and the non-inverting buffer have small voltage swing output signals.

7. The electronic display system of claim 6 wherein the display driver IC comprises a low voltage regulator that generates positive and negative power supply voltages used to produce the small voltage swing signals, and a high voltage regulator that produces positive and negative power supply voltages used to produce the large voltage swing signals.

8. The display system of claim 7 wherein the buffer circuits in the driver IC are powered by the positive and negative power supply voltages generated by the high voltage regulator, and the inverter and the non-inverting buffer are powered by the positive and negative power supply voltages generated by the low voltage regulator.

9. An electronic display system comprising:

a light transmissive panel;

a region of display elements on the panel;

a plurality of source lines coupled to the display elements;

a plurality of gate lines coupled to the display elements;

gate driver circuitry having on-panel transistors that are coupled to the gate lines;

a demultiplexer circuit having a plurality of groups of pass gates wherein each pass gate comprises a pair of complimentary on-panel transistors, and wherein a plurality of signal outputs of each group of pass gates are connected to a respective group of the plurality of source lines; and a display driver integrated circuit (IC) to receive video data and timing control signals, wherein a signal input of each group of the plurality of groups of pass gates is connected to a respective output pin of the driver IC, the display driver IC to provide digital timing control signals that have small voltage swing and that drive control electrodes of the pass gates of the demultiplexer circuit, wherein the display driver IC is to generate further control signals that have large voltage swing and that drive the gate driver circuitry, and wherein the display driver IC comprises a plurality of buffer circuits each being coupled to drive a) one of a pair of control electrodes of a respective one of the pass gates through an inverter and b) another one of the pair of control electrodes of the respective pass gate through a non-inverting buffer, and wherein the inverter and the non-inverting buffer have small voltage swing output signals.

10. The system of claim 9 wherein the display driver IC comprises a low voltage regulator that generates positive and negative power supply voltages used to produce the small voltage swing signals, and a high voltage regulator that produces positive and negative power supply voltages used to produce the large voltage swing signals.

* * * * *